US005537949A

United States Patent [19]

Blevins et al.

[11] Patent Number: 5,537,949

[45] Date of Patent: Jul. 23, 1996

[54] DIVER'S BOARDING LADDER

[75] Inventors: Roger L. Blevins, Mt. Juliet; Alan L. Stinson, Gallatin; Gary A. Zittrower, Antioch, all of Tenn.

[73] Assignee: Outboard Marine Corporation, Waukegan, Ill.

[21] Appl. No.: 394,354

[22] Filed: Feb. 24, 1995

[51] Int. Cl.[6] ..... B63B 17/00

[52] U.S. Cl. ..... 114/362

[58] Field of Search ..... 114/362, 343; 182/93, 194, 196

[56] References Cited

U.S. PATENT DOCUMENTS

| | | | |
|---|---|---|---|
| 4,846,303 | 7/1989 | Cooper et al. . | |
| 4,989,691 | 2/1991 | Wilkerson et al. . | |
| 5,188,056 | 2/1993 | Bonnet . | |
| 5,191,854 | 3/1993 | Lehmann et al. | 114/362 |

FOREIGN PATENT DOCUMENTS

| | | | |
|---|---|---|---|
| 127286 | 10/1980 | Japan | 114/362 |
| 166791 | 7/1986 | Japan | 114/362 |
| 1279904 | 12/1986 | U.S.S.R. | 114/362 |

*Primary Examiner*—Stephen Avila
*Attorney, Agent, or Firm*—Greer, Burns & Crain, Ltd.

[57] ABSTRACT

An improved diver's boarding ladder and dive door for a boat having a dive opening. The boarding ladder is positionable between a boarding position and a storage position without having to be removed and stored. In the boarding position, the dive opening is opened and the boarding ladder extends below the waterline to assist swimmers and divers in boarding the boat from the water. In the storage position, the dive door closes the dive opening and the boarding ladder is stored out of the way inside the boat's hull in an inverted position. The boarding ladder is secured in the dive opening with a hinge that runs along the entire length of the bottom of the dive opening and acts as a chafe plate to prevent damage to the boat's hull from dive equipment.

16 Claims, 2 Drawing Sheets

DIVER'S BOARDING LADDER

BACKGROUND OF THE INVENTION

Field of the Invention

The present invention relates generally to ladders. More particularly, the present invention relates to boarding ladders for marine vehicles or the like in which the ladder can be deployed for boarding the vehicle from the water or can be placed in a storage position during periods of nonuse.

Background Information

The sport of diving often necessitates the use of heavy, oversized equipment. Therefore, it is often difficult for divers to climb over the boat's edge while carrying a load of diving equipment. Furthermore, it is also difficult for divers to gracefully enter the water from inside the boat.

Boarding ladders have been developed to assist a diver in entering a boat from the water. While boarding ladders do assist in boarding, it is still often difficult to have to climb over the boat's edge, even with a ladder. For these reasons, dive openings have been provided to ease the difficulties encountered in exiting and entering a boat while weighted down with diving equipment.

Dive openings are cut-out sections in the hull of the boat which lower entry freeboard. Therefore, boarding is usually accomplished through a dive opening. Dive openings are often configured with chafe plates to prevent dive tanks, weights or other objects from chipping or chafing away pieces of the hull. However, because the dive openings lower entry freeboard, the boat will oftentimes take on water through the dive opening during operation. A dive opening also detracts from the boat's overall aesthetic appearance by leaving a gaping hole in the side of the boat's hull.

Dive door inserts have been manufactured to be inserted into the dive openings to help prevent the take on of water through the dive openings. They are generally configured to resemble the boat's hull design so as to present a visually pleasing aesthetic image when in place. When the dive opening is in use, the dive door inserts are generally removed and stored on the boat deck facilitating boarding and exiting as mentioned above. However, when the dive door is not secured in the dive opening it creates a safety hazard lying on the deck and presents an opportunity for the door to be misplaced or lost. Furthermore, it occupies valuable deck space leaving less room for other more important equipment.

Dive ladders have also been manufactured to be inserted into the dive openings to help assist swimmers and divers in boarding the boat. Dive ladders are generally configured to extend below the waterline so the swimmers or divers can easily reach the bottom step on the ladder. When not in use the dive ladders are generally removed from the dive opening and stored on the boat deck. This presents problems similar to those mentioned above pertaining to the dive door when it is not in use.

Accordingly, it is a general object of the present to provide an improved dive door and boarding ladder for a marine vehicle.

It is another object of the present invention to provide an improved boarding ladder which can be positioned in a boarding position and a storage position without having to detach the boarding ladder from the dive opening.

It is still another object of the present invention to provide an improved dive door which can be positioned in a boarding position and a storage position without having to detach the dive door from the dive opening.

It is a further object of the present invention to provide a dive door and boarding ladder system in which both the dive door and the boarding ladder can be positioned in a boarding position and a storage position without having to detach either from the dive opening.

It is a still further object of the present invention to provide a dive door and boarding ladder system containing a chafe plate formed integrally therewith to protect the boat from chipping or chafing caused by dive equipment.

It is another object of the present invention to provide a dive door and boarding ladder system that does not detract from the boat's overall aesthetic appearance.

Other features and advantages of the present invention will be apparent from the following description taken in conjunction with the accompanying drawings.

SUMMARY OF THE INVENTION

In order to achieve the foregoing object, the present invention provides a diver's boarding ladder configured integrally with a dive door and chafe plate for installation in a dive opening in a boat. The boarding ladder can be positioned in a boarding position and a storage position.

In the boarding position, the dive opening is open and is positioned just above the waterline. The boarding ladder extends from the dive opening into the water so that a swimmer or diver can use the boarding ladder to board the boat through the dive opening. The dive door is positioned out of the way, between the boarding ladder and the hull.

In the storage position, the dive door closes the dive opening and the boarding ladder is positioned to the inside of the hull in an inverted position. The dive door is configured to resemble the boat's hull design so as to present a visually pleasing aesthetic image. The bottom step of the ladder is configured to resemble a railing attached to the hull also to present a visually pleasing aesthetic image. The dive door is configured with gaskets to help reduce leakage through the dive opening.

The dive door and boarding ladder are attached to the dive opening with a hinge that runs the length of the bottom edge of the dive opening. The hinge is configured to act as a chafe plate to prevent damage to the boat from dive equipment, etc.

DESCRIPTION OF THE PREFERRED EMBODIMENT

Figure 2:
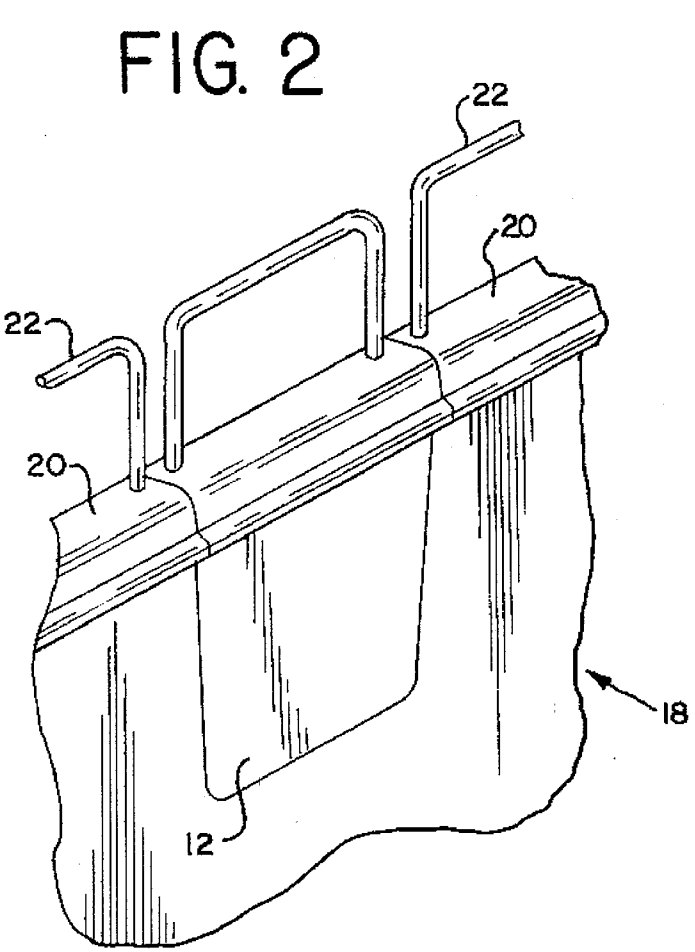
FIG. 2 is a perspective view of the boarding ladder and dive door in the storage position.
Figure 1:
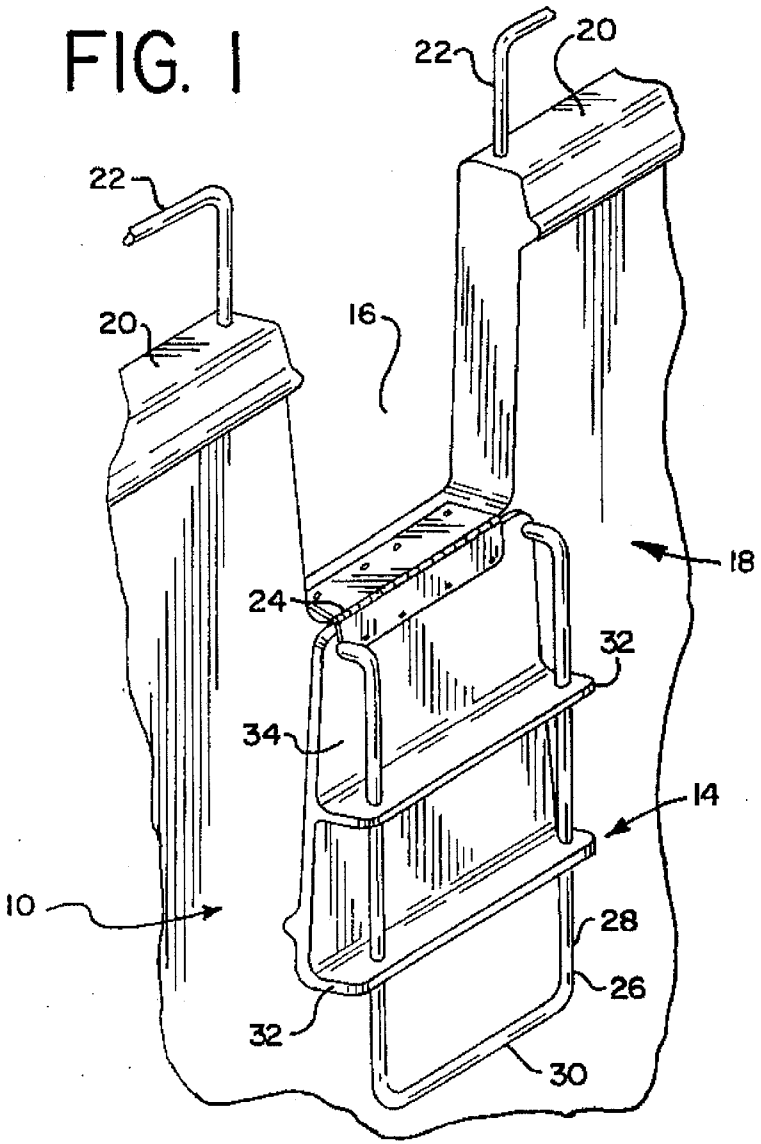
FIG. 1 is a perspective view of the boarding ladder and dive door installed on a cut-away portion of a boat's hull having a dive opening, showing the boarding ladder and dive door in the boarding position.

Broadly stated, the present invention presents a boarding ladder and dive door, configured to be mounted in a dive opening in the hull of a boat so that they may be rotated between a boarding position and a storage position. The boarding ladder and dive door are mounted to the dive opening by a hinge that runs the entire length of the bottom of the dive opening and which acts as a chafe plate to prevent damage to the boat from diving tanks, weights or other equipment. In the boarding position, the dive opening is open and the ladder extends into the water. In the storage position, the dive opening is closed by the dive door and the boarding ladder is stored in an inverted position on the inside of the hull.

Preferred embodiments of an improved diver's boarding ladder are described herebelow with reference to the drawings.

The improved diver's boarding ladder, indicated generally at 10, is a combination dive door 12 and boarding ladder 14 connected to a dive opening 16 in the hull 18 of a boat. The hull 18 may be integrally formed or may include sides separately attached. The hull 18 has a top portion 20 to which protective rail sections 22 may be attached for safety reasons. A hinge 24, which runs the length of the bottom of the dive opening, connects the diver's boarding ladder 10 to the boat. The hinge 24 acts as a chafe plate to prevent dive tanks, weights or other objects from chipping or chafing away pieces of the hull.

Figure 4:
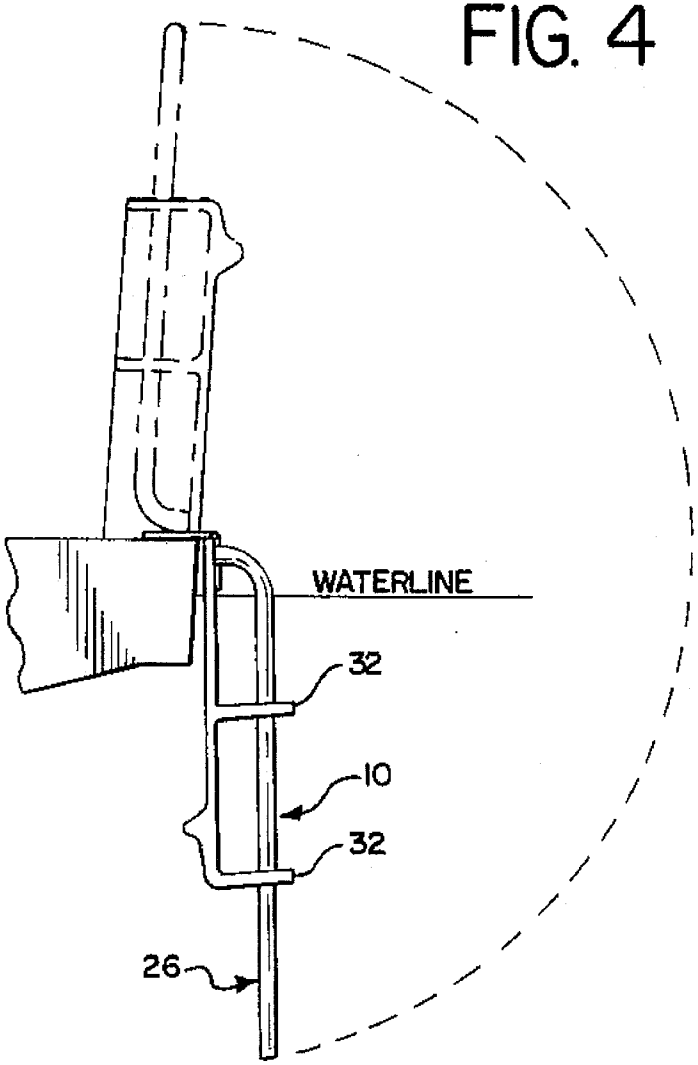
FIG. 4 is a side view of the boarding ladder and dive door shown in FIG. 3.
Figure 3:
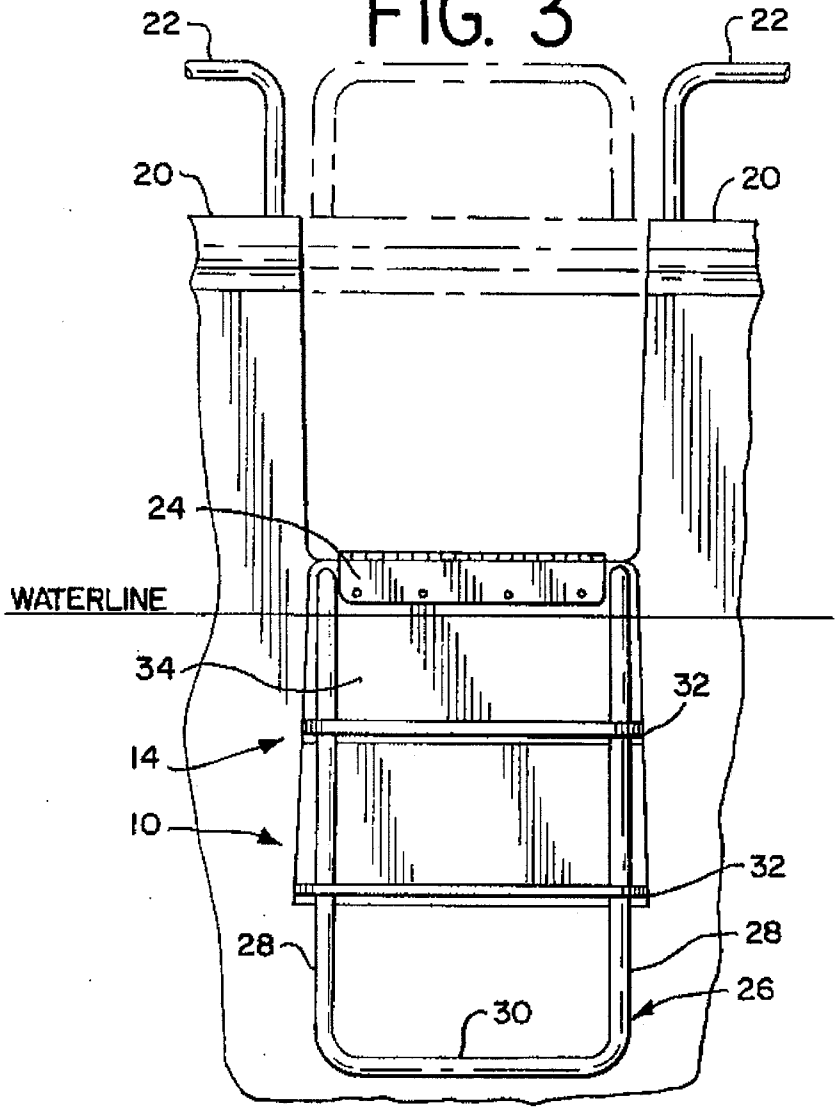
FIG. 3 is a front view of the boarding ladder and dive door showing the boarding ladder and dive door in the boarding position (in solid lines) and in the storage position (in broken lines)

The boarding ladder 14 is made of a U-shaped frame 26, having two vertical hand rails 28 and a horizontal bottom step 30, and a plurality of molded steps 32 integrally formed on the inside of the dive door 34. In the boarding position, the dive door 12 swings down around the hinge 24 opening the dive opening 16. The boarding ladder 14 extends below the waterline, as best shown in FIGS. 3 and 4.

In the storage position, the dive door 12 is positioned in the dive opening 16, completely closing the dive opening 16. The dive door is preferably equipped with gaskets (not shown) to reduce leakage and can be locked in the storage position with a locking mechanism (not shown) to prevent the dive door 12 from opening unintentionally. In this position, the boarding ladder 14 rotates about the hinge 24 into an inverted position inside the boat's hull 18. The outside of the dive door 12 is molded to resemble the boat's hull design to present a visually pleasing aesthetic image. The horizontal bottom step 30 is also configured to extend above the dive door 12, in the storage position, to provide a railing that appears to be similar to one on the rest of the boat's hull.

It will be appreciated that the above-disclosed embodiment is well calculated to achieve the aforementioned objectives of the present invention. In addition, it is evident that those skilled in the art, once given the benefit of the foregoing disclosure, may now make modifications of the specific embodiment described herein without departing from the spirit of the present invention. Such modifications are considered within the scope and spirit of the appended claims.

What is claimed is:

1. A boarding ladder for a boat having a hull with a dive opening, said ladder comprising:

a ladder hingably attached to the hull in the dive opening so that said ladder can be rotated between a boarding position and a storage position; and a dive door operably connected to said ladder;

said ladder having a generally U-shaped frame consisting of two substantially straight vertical portions and a substantially straight horizontal portion, and having at least one step integrally formed with said dive door and operably connected to said frame.

2. A boarding ladder according to claim 1 wherein said dive door is positioned between said ladder and the hull when said ladder is in said boarding position, thereby opening the dive opening, the dive opening having a bottom edge positioned above a waterline created when the boat is on a body of water; and said ladder being configured to extend below said waterline when in said boarding position.

3. A boarding ladder according to claim 1, wherein said ladder is hingably attached with a hinge positioned to cover a bottom edge of the dive opening and a top edge of said boarding ladder and configured to act as a chafe plate to prevent the hull from damage from diving tanks and other equipment.

4. A boarding ladder according to claim 1, wherein said ladder is positioned above said waterline and said dive door is configured to close said dive opening when said ladder is in said storage position.

5. A boarding ladder according to claim 1 wherein said horizontal portion is configured as a step on said ladder when said ladder is in said boarding position.

6. A boarding ladder for a boat having a hull with a dive opening, said ladder comprising:

a U-shaped frame consisting of two substantially straight vertical portions and a substantially straight horizontal portion;

a dive door operably connected to said frame and hingably attached to said hull in said dive opening so that said dive door can rotate between a boarding and storage position; and at least one step integrally formed with said dive door and operably connected to said frame so that when said dive door is in said boarding position said at least one step can be used to enter the boat from outside the boat and a bottom edge of the dive opening is positioned above a waterline created when the boat is on a body of water.

7. A boarding ladder according to claim 6, wherein said dive door is hingably attached with a hinge positioned to cover a bottom edge of the dive opening and a top edge of said boarding ladder and configured to act as a chafe plate to prevent the hull from damage from diving tanks and other equipment.

8. A boarding ladder according to claim 6 wherein the ladder is positioned above said waterline and said dive door is configured to close said dive opening when said dive door is in said storage position.

9. A boarding ladder according to claim 6 wherein said horizontal portion is configured as a step on the ladder when said dive door is in said boarding position.

10. A boarding ladder according to claim 6 wherein the ladder is configured to extend below said waterline when said dive door is in said boarding position.

11. A dive door for a boat having a hull with a dive opening, said dive door comprising:

a dive door hingably attached to the hull in the dive opening so that said dive door can be rotated between a boarding and storage position; and, a ladder operably connected to said dive door, said ladder comprising a U-shaped frame consisting of two substantially straight vertical portions and a substantially straight horizontal portion operably connected to said dive door and at least one step integrally formed with said dive door and operably connected to said frame so that when said dive door is in said boarding position, said at least one step can be used to enter the boat from outside the boat, a bottom edge of the dive opening being positioned above a waterline created when the boat is on a body of water, said ladder being configured to extend below said waterline and said horizontal portion being configured as a step on said ladder.

12. A dive door according to claim 1, wherein said dive door is hingably attached with a hinge positioned to cover a bottom edge of the dive opening and a top edge of said boarding ladder and configured to act as a chafe plate to prevent the hull from damage from diving tanks and other equipment.

13. A dive door according to claim 1 wherein said ladder is positioned above said waterline and said dive door is configured to close said dive opening when said dive door is in said storage position.

14. In a pleasure boat of the type which has a hull having a plurality of protective rail sections attached to the top side of the hull, the rail sections having generally horizontal portions spaced from the top side of the hull, the hull having at least one generally rectangular opening extending from the top of the hull to a lower elevation, the opening being sufficiently large to enable a person to exit or enter the boat, a combination door and ladder for covering the opening and providing a ladder for facilitating egress and ingress to and from the water, said combination comprising:

a door means having an exterior surface that is generally coextensive with the outer surface of the hull when the door means is closed, said door means being vertically pivotable around a generally horizontal axis for uncovering and covering the opening, said axis being proximate said lower elevation of the opening and at one end portion of said door means;

ladder means attached to said door means for facilitating egress and ingress from the water, said ladder means having a step portion that is generally spaced a predetermined distance from a second end portion of said door means that is opposite said first end portion, said predetermined distance being generally the same as the spacing between the horizontal portion of the rail sections adjacent the rectangular opening and the top side of the hull;

one of said ladder means and said door means providing at least one horizontal foot step for enabling egress and ingress from the water.

15. A combination door and ladder according to claim 14, wherein said combination is attached to the hull with a hinge positioned to cover the lower elevation and configured to act as a chafe plate to prevent the hull from damage from diving tanks and other equipment.

16. A combination door and ladder according to claim 14 wherein said ladder means is configured to extend below a waterline when said door means is pivoted around said horizontal axis into a boarding position.

* * * * *